United States Patent [19]

Waterman

[11] Patent Number: 4,594,749

[45] Date of Patent: Jun. 17, 1986

[54] VACUUM CLEANER WITH AIR JET ASSIST

[76] Inventor: Dale G. Waterman, P.O. Box 1492, LaCrosse, Wis. 54601

[21] Appl. No.: 670,045

[22] Filed: Nov. 13, 1984

[51] Int. Cl.[4] ..... A47L 9/08

[52] U.S. Cl. ..... 15/345; 15/359; 15/375; 15/419; 15/421

[58] Field of Search ..... 15/375, 345, 419, 421, 15/354, 359, 376

[56] References Cited

U.S. PATENT DOCUMENTS

| | | | |
|---|---|---|---|
| 1,900,886 | 3/1933 | Smellie | 15/375 |
| 2,502,612 | 4/1950 | Woock | 15/421 X |
| 3,268,942 | 8/1966 | Rossnan | 15/346 |
| 3,694,848 | 10/1972 | Alcala | 15/346 |
| 4,207,650 | 6/1980 | Crise | 15/346 X |

*Primary Examiner*—Chris K. Moore

*Attorney, Agent, or Firm*—Fuller, House & Hohenfeldt

[57] ABSTRACT

A vacuum cleaner head with a hood which closely fits the floor has a rotor with a plurality of nozzles supported on a hub with a slot. Outside air is drawn through the hub and nozzles into the hood to provide air jets from the nozzles which assist in disloging particles for recovery by the vacuum.

4 Claims, 3 Drawing Figures

VACUUM CLEANER WITH AIR JET ASSIST

FIELD OF THE INVENTION

The invention relates to a vacuum cleaner head which includes an air jet assist for dislodging particles into the vacuum cleaner head to assist in removal therefrom by the vacuum.

BACKGROUND OF INVENTION

The invention relates to a vacuum head which is intended for use on supporting surfaces such as shag carpets in which it is difficult to remove particles with a conventional vacuum cleaner head. Although various vacuum heads have been developed which employ jets of gas into the confines of the vacuum hood to dislodge particles, this type of system has not been practically employed in a conventional home vacuum cleaner. A separate source of high pressure air is typically employed in the prior art devices in order to achieve the air velocities required. U.S. Pat. No. 3,678,534 is an example of a vacuum cleaner head with gas jets.

THE SUMMARY OF THE INVENTION

The present invention provides a vacuum cleaner head in which a rotor having a plurality of protruding nozzles is moved about as a consequence of engagement with the supporting surface during use. The rotor is mounted on a hub provided with an elongated valve opening to supply outside air to the nozzles which discharge the air within the confines of the hood during vacuum use. The valve opening is positioned to supply air to the nozzles only when the row of nozzles is aligned to discharge downwardly toward the supporting surface. The outside air can either be room air or can be the discharge from the filtered air from the vacuum cleaner blower. Even without high pressure air to the nozzles the vacuum within the confines of the hood can cause outside air to flow through the nozzles. The hood has a lower edge intended for contact with the floor and to provide a limited seal to enhance the vacuum within the hood.

The rotor and the nozzles can be flexible and bendable during the course of use of the vacuum when engaging a hard surface to thus to change the angle of discharge of the air exiting the nozzles to provide a random pattern which will assist in complete circulation within the hood to provide for more positive pick up of debris. However, a hard rubber or plastic rotor and nozzles may be adequate to accomplish the objectives of the invention.

Other objects, advantages and features of the invention will become apparent from the disclosure.

DESCRIPTION OF PREFERRED EMBODIMENT

Although the disclosure hereof is detailed and exact to enable those skilled in the art to practice the invention, the physical embodiments herein disclosed merely exemplify the invention which may be embodied in other specific structure. The scope of the invention is defined in the claims appended hereto.

The vacuum cleaner hood 2 includes a marginal or peripheral edge 5 which forms the lower edge of the skirt of the hood 2. It is intended that this marginal edge 5 be in close contact or spacing or in sealing engagement with the supporting surface or other surface to be cleaned to enhance the vacuum in the hood to cause air flow through the nozzles as hereinafter described as a result of a pressure differential between the zone inside the hood and outside the hood. The vacuum hood also includes a hollow neck or connector 1 which is connectable to a source of vacuum to cummunicate with the interior of the hood 2.

Figure 1:
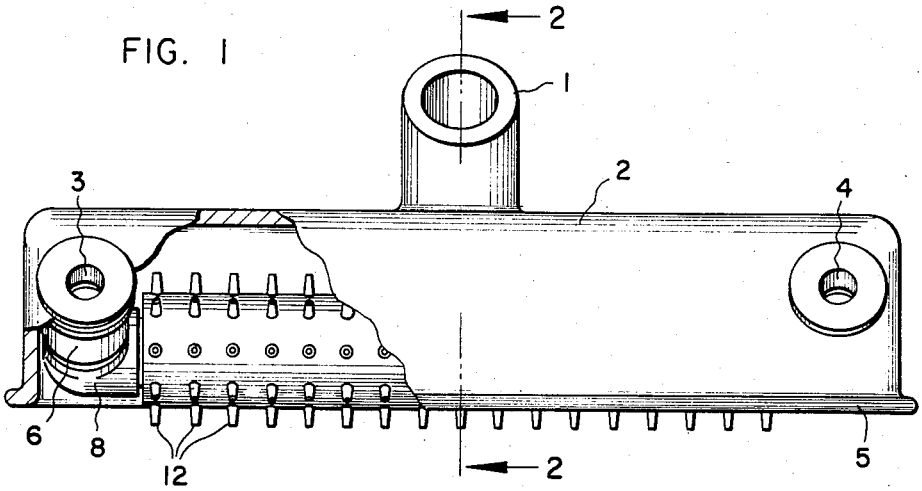
FIG. 1 is a side view partially broken away of the vacuum head of the invention.
Figure 2:
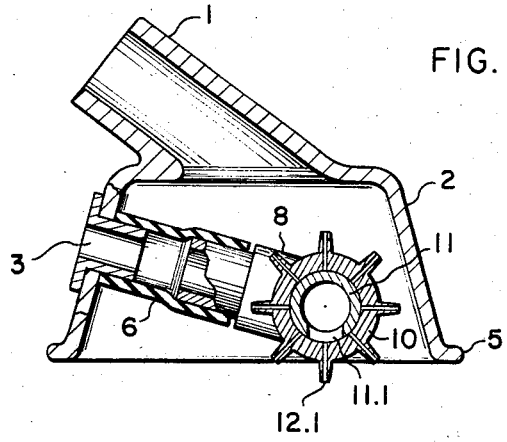
FIG. 2 is a sectional view along line 2—2 of FIG. 1.

The hood is provided with a rotor 10 which is hollow and is supported on a hub 11 having a through slot 11.1 which serves as a valve opening for communication of outside air with the nozzles 12.1 on the rotor 10. The hub 11 is elongated and substantially spans the length of the hood and is supported within the confines of the hood by flexible connectors 6 and 7 which are anchored to the hood by inlet bushings 3 with flanged heads. The flexible connectors 6 and 7 enable slight movement of the rotor within the hood from the position shown in FIG. 2 in response to engagement of the rotor with the supporting surface. Also if the supporting surface is rigid the nozzles 12.1 as illustrated in FIG. 2 would be deflected or bent. Elbows 8 and 9 are connected to the rotor and connected to the inlets by the flexible connectors 6 and 7 which enable the entire rotor assembly to be urged against the floor.

If the rotor and/or the individual nozzles are made of a flexible material such as a soft plastic or rubber, the nozzles will be deformed during use particularly against a hard surface. This will result in differing angles of discharge of the air exiting the nozzles to assist in more random circulation of the incoming air within the hood which can assist particle recovery.

Figure 3:
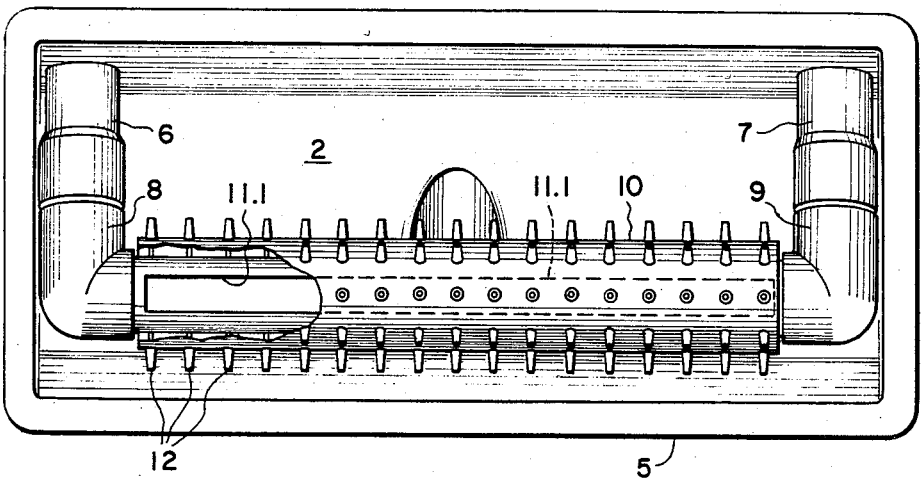
FIG. 3 is a bottom view of the vacuum cleaner head shown in FIG. 1.

The nozzles 12.1 are desirably oriented in rows parallel to the axis of rotation so that a plurality of the nozzles will be in registry with the slot 11.1 as illustrated in FIGS. 2 and 3 at any one time. The width of the slot 11.1 will determine the length of time that the air nozzles are in communication with the outside air source and also the angle that the nozzles will be positioned at during the interval in which they are supplied by air. This slot width can be varied to suit particular applications.

I claim:

1. A vacuum head having a downwardly open hood having an air supply inlet and an outlet connectable to a source of vacuum, a rotor with a plurality of air nozzles, support means for rotatably supporting said rotor within the cavity of said hood and including valve means for connecting said air supply inlet to said rotor whereby air is discharged through the nozzles as a result of a pressure differential between the inside of the hood and outside of the hood at a predetermined position as said rotor is rotated during use on a supporting surface and wherein said support means includes a hollow hub and wherein said rotor includes an elongated tube with a pluraltity of protruding nozzles wherein said nozzles are arranged in longitudinal rows and said valve means comprises a longitudinal slot in said hub registerable, in sequence with each row of nozzles to afford discharge of air from said nozzles to stir up debris to be recovered by the vacuum in said hood.

2. The vacuum head of claim 1 wherein said nozzles are formed from flexible material and are deformable in the course of engagement with the supporting surface to change the angle of air discharge from the jets to provide air discharge in random directions.

3. The vacuum head of claim 2 wherein said nozzles are arranged in a pattern to provide a sweeping action during use.

4. The vacuum head of claim 1 wherein said support means flexibly connects said rotor to said hood to downwardly urge said rotor against the supporting surface and is yieldable upwardly in response to irregularities in the supporting surface.

* * * * *